United States Patent [19]

Kohler

[11] Patent Number: 4,739,805

[45] Date of Patent: Apr. 26, 1988

[54] RAPIER FOR A SHUTTLELESS LOOM

[75] Inventor: Lothar Kohler, Tann-Ruti, Switzerland

[73] Assignee: Sulzer Brothers Limited, Winterthur, Switzerland

[21] Appl. No.: 11,157

[22] Filed: Feb. 5, 1987

[30] Foreign Application Priority Data

Feb. 13, 1986 [CH] Switzerland ..... 00671/86

[51] Int. Cl.[4] ..... D03D 47/20

[52] U.S. Cl. ..... 139/448

[58] Field of Search ..... 139/447, 448

[56] References Cited

U.S. PATENT DOCUMENTS 4,371,008 2/1983 Freisler ..... 139/448

4,417,606 11/1983 Corain ..... 139/448

*Primary Examiner*—Henry S. Jaudon

*Attorney, Agent, or Firm*—Kenyon & Kenyon

[57] ABSTRACT

The rapier has a tongue tip which is guided positively in an insert within a grip hook in directions perpendicular to the plane in which the hook is disposed. A mating groove and projection arrangement is disposed between the tongue tip and a flank of the shaped insert within the hook in order to preclude transverse movements of the tongue tip relative to the hook insert. A clamping plate is disposed on the side of the tongue tip to enhance the positive guiding of the tongue tip within the hook insert.

15 Claims, 4 Drawing Sheets

RAPIER FOR A SHUTTLELESS LOOM

This invention relates to a rapier for a shuttleless loom.

As is known, looms of the shuttleless type frequently employ a rapier for the picking of a weft yarn across the width of the loom. Generally, such a rapier is constructed of a grip hook which extends from a casing and an associated grip tongue which is movable by means of a spring force longitudinally of the grip hook.

Further, the head of the tongue is usually provided with a gripping surface which is disposed opposite a gripping flank of the hook which is inclined to the direction of rapier movement in order to retain a weft yarn therebetween during picking. As described in German O.S. No. 3136615, it has been known to have one end of the rapier grip tongue pivoted to a bent lever via a link so that when the lever is actuated, the tongue moves in a longitudinal guide in the rapier. Also, when the bent lever is not acted upon by an external force, the tongue is pivoted by a spring strip so that the tongue is pressed into a wedge-shaped recess in the hook. Similar constructions are also disclosed in other publications, such as European Patent Application No. 0123005.

In both the above noted publications, rectilinear guides are provided for a stem of the tongue and are disposed in the rapier casing. However, one disadvantage of such a construction is that the tip or head of the tongue is not guided accurately relative to the hook. Thus, when fine yarns are being woven at high picking rate, there may be a relative movement, for example, due to vibration, between the tongue tip and the hook during picking. Should this occur, the clamped part of the yarn may be damaged or may slip out of the hook before completion of picking.

Accordingly, it is an object of the invention to provide a rapier for a shuttleless loom in which a tongue tip can be guided with a reduced clearance.

It is another object of the invention to provide a rapier capable of gripping fine yarns which are woven at high picking rates.

It is another object of the invention to eliminate relative transverse movement between a tongue tip and a grip hook of a rapier.

Briefly, the invention provide a rapier for a shuttleless loom which is comprised of a casing, a grip hook which extends from the casing, a grip tongue which is movably mounted in the casing and which has a tip for engaging within the hook to grip a weft yarn therebetween and means for guiding the tongue tip longitudinally within the hook to prevent transverse movement of the tongue tip relative to the hook.

The guiding means for the tongue tip provides a positive means for retaining the tip against transverse motion relative to the hook. This means prevents the tongue from vibrating relative to the hook precisely at the place where the weft yarn is retained, i.e. at the tongue tip.

The grip hook may also be provided with an insert, for example having a pair of angularly disposed opposed flanks for slidably receiving a wedge-shaped tip of the tongue. In such cases, the means for positively guiding and retaining the tongue tip in the hook includes a groove in one of the insert and tongue and a projection on the other of the insert and tongue with the projection slidably disposed in the groove. Various mating shapes of grooves and projection may be used in this respect.

These and other objects and advantages of the invention will become more apparent from the following detailed description taken in conjunction with the accompanying drawings wherein.

Figure 1:
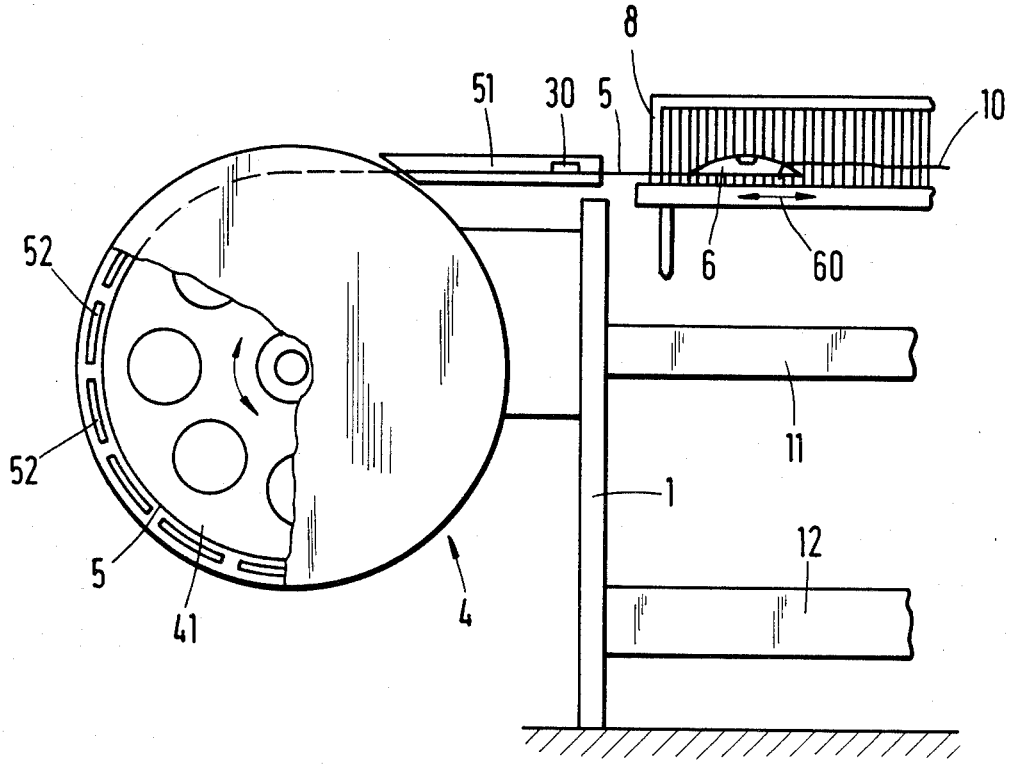
FIG. 1 illustrates a view of a part of a shuttleless loom having a rapier drive.

Referring to FIG. 1, a shuttleless loom frame 1 is provided with a rapier drive transmission 4 as well as central beams or supports 11, 12. As is conventional, a reed 8 is disposed above the beams 11, 12.

The rapier drive transmission 4 includes a driving wheel 41 which acts by way of a drive tape 5 to reciprocate a rapier 6 along the reed 8 in a longitudinal direction as indicated by the double arrow 60.

Figure 2:
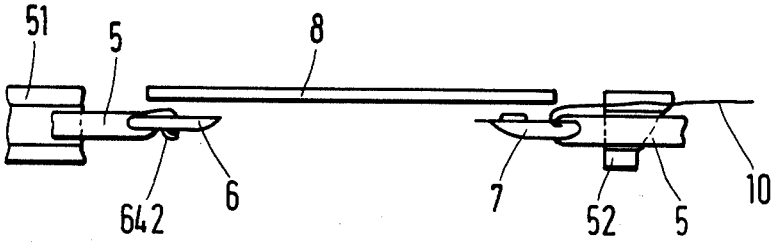
FIG. 2 illustrates a plan view of a part of the shuttleless loom of FIG. 1 to further illustrate the rapier drive.

As indicated in FIG. 2, during operation, a weft yarn 10 is picked from right to left, as viewed, by a weft carrying rapier 7 which is also driven by a flexible tape 5 with the rapier 7 picking the yarn 10 to the left as far as the center of the reed 8. Thereafter, the take-up rapier 6 takes the yarn 10 and completes picking. At the end of picking, a lever 642 which projects from the rapier 6 strikes a cam 30 within the transmission 4 so that the rapier 6 releases the picked yarn.

As indicated in FIG. 2, each of the rapier tapes 5 is guided on the loom frame by respective guides 51, 52.

Figure 3:
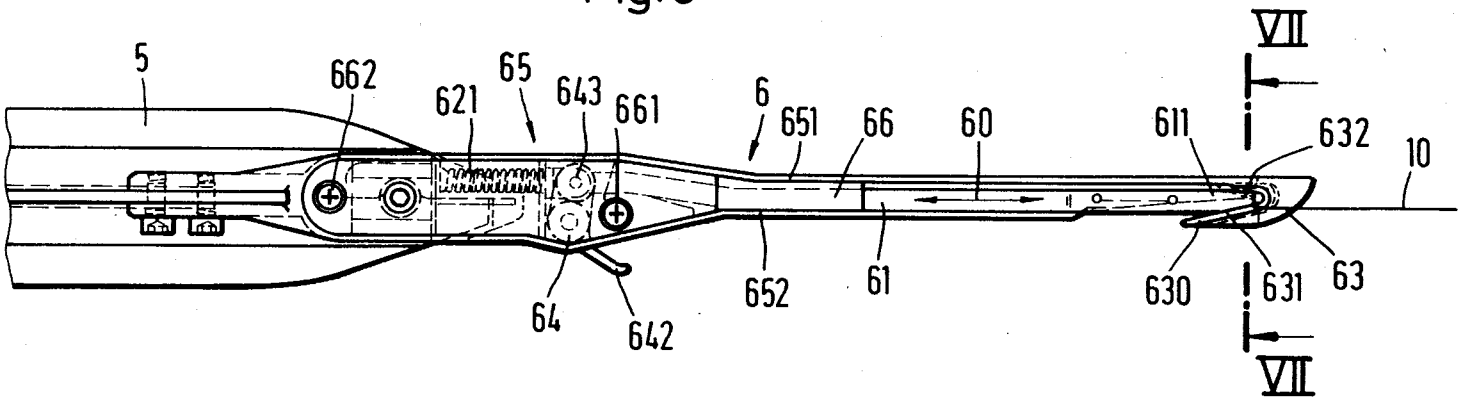
FIG. 3 illustrates a side view of a rapier constructed in accordance with the invention.
Figure 4:
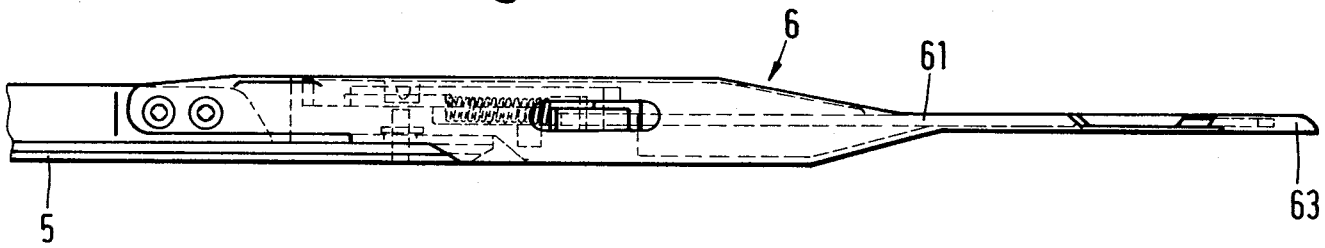
FIG. 4 illustrates an inverted plan view of the rapier of FIG. 3.

Referring to FIGS. 3 and 4, the take-up rapier 6 is secured to the tape 5 and basically comprises a casing 65 having side walls 651, 652. In addition, a grip hook 63 extends from the casing 65 for engaging the weft yarn 10. In this regard, the hook 63 has an insert 630 disposed therein. This insert 630 has a pair of angularly disposed opposed flanks 631, 632.

The rapier 6 also has a grip tongue 61 disposed between the side walls 651, 652 and which extends into the hook 63. In this respect, the grip tongue 61 has a tip which is of wedge-shape so as to be slidably received within the insert 630 of the grip hook 63. The casing 65 is also provided with a cover 66 which is secured thereon by screws 661, 662 in order to protect the tongue 61. As indicated in FIG. 3, during picking, a yarn 10 is retained between the grip hook 63 and the tip 611 of the tongue 61.

Figure 6:
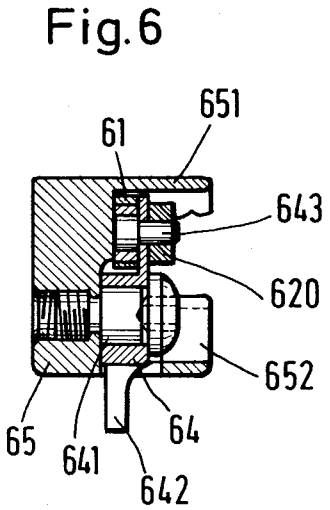
FIG. 6 illustrates a view taken on line VI—VI of FIG. 5.
Figure 5:
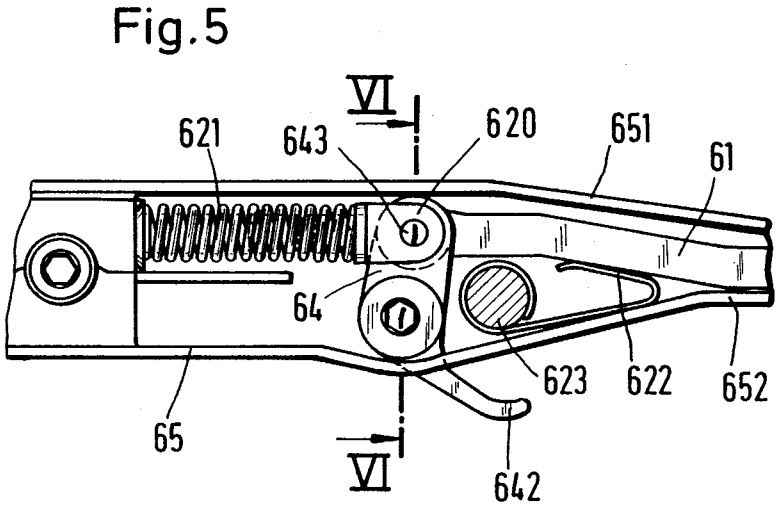
FIG. 5 illustrates an enlarged view of a part of the rapier of FIG. 3.

Referring to FIGS. 5 and 6, a lever 64 is pivotally mounted on a pivot pin 641 within the casing 65 as to be freely rotatable relative to the casing. This lever 64 carries the end 642 which engages the cam 30 (see FIG. 1) in order to retract the tongue 61 relative to the hook 63 for releasing a weft yarn. In addition, the lever 64 is connected via a common pin 643 to a link 620 and the stem end of the tongue 61. A spring 621 is, in turn, disposed between the link 620 and a stationary part of the casing 65 in order to bias the lever 64 in a clockwise direction, as viewed in FIG. 1, in order to move the tongue 61 into engagement with the hook 63. In addition, a hairpin spring 622 is mounted on a pivot 623 within the casing 65 and is disposed below the tongue 61 so as to bias the tongue 61 in a counterclockwise direction about the pin 643.

In use, when the take-up rapier 6 is moved to the left, the end of the lever 642 is pivoted via the cam 30 in a counterclockwise direction. Thus, the tongue 61 is moved away from the hook 63 so that the weft yarn 10 is released. During this movement, which is indicated by the double arrow 60 in FIGS. 1 and 3, the tongue 61 slides over the end of the hairpin spring 622. Consequently, the tongue 61 is pivoted on the pin 643 in a counterclockwise manner, as viewed. After the rapier 6 begins a right hand movement, as viewed in FIGS. 1 and 2, the lever 64 disengages from the cam 30 so that the spring 621 moves the tongue 61 to the right and into engagement with the hook 63. The tip 611 of the tongue 61 is then pressed into the insert 630 in the hook 63.

Figure 7:
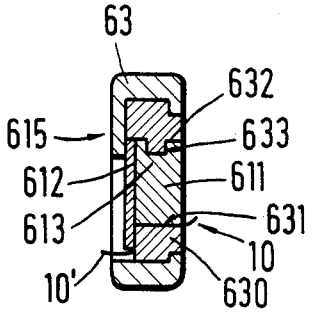
FIG. 7 illustrates a view taken on line VII—VII of FIG. 3.

Referring to FIGS. 3 and 7, the rapier is also provided with a means for a guiding and retaining the tongue 61 in the hook 63. In this respect, the means guides the tongue tip 611 longitudinally within the insert 630 of the hook 63 in order to prevent transverse movement of the tongue tip 611 relative to the hook 63. As indicated in FIG. 7, this positive guide means includes a groove 613 which is formed in an upper surface of the tongue tip 611 and a projection 633 which is formed on the insert flank 632 to be matingly received within the groove 613. The horizontal clearance between the grooves 613 and the projection 633 is very reduced in order to obviate horizontal relative movement between the tongue tip 611 and the insert 630. As indicated, the lower surface of the tongue tip 631 bears on the flanks 631 of the insert 630 in order to grip a weft yarn 10 therebetween.

When the tongue tip 611 is in the position illustrated in FIG. 7, the compression spring 621 presses the tongue tip 611 onto the lower insert flank 631 with both flanks 631, 632 taking up the pressure of the spring 621.

A clamping plate 612 is also secured to the tongue tip 611 and has an upper edge disposed between the hook 63 and the tongue tip 611. As shown in FIG. 7, the lower edge of the clamping plate 612 extends below the tongue tip 611 and engages along the flank 631 of the insert 630 so that the weft yarn end is deflected inwardly and, therefore, retained more reliably than in the absence of the clamping plate 612.

As indicated in FIG. 3, the tongue tip 611 has a wedge-shaped end to fit into the insert 630. When the tongue 61 is withdrawn from the hook 63 due to pivoting of the lever 64 on the cam 30, the hairpin spring 622 (see FIG. 5) presses the tongue tip 611 onto the upper flank 632 of the insert 630. Since the flanks 61, 632 are both inclined to the direction of movement of the tongue 61 as indicated by the double arrow 60, after a short movement, a gap arises between the tongue tip 611 and the lower flank 631 so that the yarn 10 can slide off the hook 63 through the gap.

Figure 8:
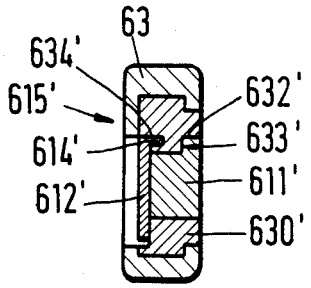
FIG. 8 illustrates a view similar to FIG. 7 with a modified means for guiding and retaining the tongue tip in an insert of the guide hook in accordance with the invention.

Referring to FIG. 8, wherein prime reference characters indicate like parts as above, the guiding and retaining means may be modified so that the clamping plate 612' has a bent end which is slidably received in a longitudinal groove 634' of the insert 630' such that the tongue tip 611' is positively guided in all directions in the plane of the drawing relative to the insert 630'. In this embodiment, the hairpin spring 622 and the pivot 623 of FIG. 5 can be omitted.

Figure 9:
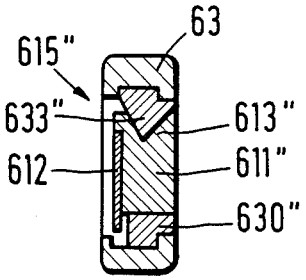
FIG. 9 illustrates a further modified guiding and retaining means in accordance with the invention.

Referring to FIG. 9, wherein double prime reference characters indicate like parts as above, the guiding and retaining means may employ a V-shaped groove 613" in the tongue tip 611" while the flank of the insert 630" has a wedge-shaped projection 633" which is received in the groove without clearance.

Figure 10:
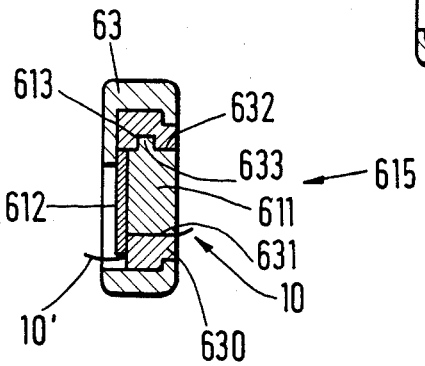
FIG. 10 illustrates a further modified cross-sectional view of a means for guiding and retaining a tongue in a hook in accordance with the invention.

Referring to FIG. 10, wherein like reference characters indicate like parts as above, the groove 613 may be disposed in the flank 632 of the insert 630 while the projection 633 is disposed on the tongue tip 611.

The invention thus provides a positive means of controlling the movement of a tongue tip in an insert of a rapier in order to positively clamp a weft yarn therebetween. The guiding means serves to prevent vibrations between the hook and tongue from causing a relative movement between the gripping surfaces of the tongue tip and hook insert.

What is claimed is:

1. A rapier for a shuttleless loom comprising a casing;

a grip hook extending from said casing for engaging a weft yarn;

a spring biased grip tongue movably mounted in said casing and having a tip for engaging said hook to grip a weft yarn therebetween;

an insert in said hook slidably receiving said tongue tip; and means for guiding and retaining said tongue tip in said hook, said means including a groove in one of said insert and said tongue tip and and a projection on the other of said insert and said tongue tip, said projection being slidably disposed in said groove.

2. A rapier as set forth in claim 1 wherein said means retains said tongue tip in said hook against transverse movement relative to said hook.

3. A rapier as set forth in claim 1 which further comprises a spring in said casing biasing said tongue into said hook.

4. A rapier as set forth in claim 1 which further comprises an insert in said hook having a pair of angularly disposed opposed flanks slidably receiving a wedge-shaped tip of said tongue.

5. A rapier as set forth in claim 4 wherein one of said flanks slidably receives said tongue tip.

6. A rapier as set forth in claim 5 wherein said means is disposed between said one flank and said tongue tip.

7. A rapier for shuttleless loom comprising a casing;

a grip hook extending from said casing;

a grip tongue movably mounted in said casing and having a tip for engaging within said hook to grip a weft yarn therebetween;

an insert in said hook having a pair of angularly disposed opposed flanks slidably receiving said tongue tip;

means for guiding said tongue tip within said hook to prevent transverse movement of said tongue tip relative to said hook;

a first spring in said casing biasing said tongue tip against one of said flanks; and a second spring in said casing biasing said tongue into said hook.

8. A rapier as set forth in claim 7 wherein said one of said flanks slidably receives said tongue tip.

9. A rapier as set forth in claim 8 wherein said means is disposed between said one flank and said tongue tip.

10. A rapier as set forth in claim 7 wherein said means includes a clamping plate secured to said tongue tip and having a bent end slidably received in said insert.

11. A rapier for a shuttleless loom comprising a casing;

a grip hook extending from said casing for engaging a weft yarn;

a spring biased grip tongue movably mounted in said casing and having a tip for engaging said hook to grip a weft yarn therebetween;

means for guiding and retaining said tongue tip in said hook; and an insert in said hook having a pair of angularly disposed opposed flanks slidably receiving a wedge-shaped tip of said tongue.

12. A rapier as set forth in claim 11 which further comprises an insert in said hook slidably receiving said tongue tip and wherein said means includes a groove in one of said insert and said tongue tip and a projection on the other of said insert and said tongue tip, said projection being slidably disposed in said groove.

13. A rapier as set forth in claim 11 which further comprises a spring in said casing biasing said tongue into said hook.

14. A rapier as set forth in claim 11 wherein one of the said flanks slidably receives said tongue tip.

15. A rapier as set forth in claim 12 wherein said means is disposed between said one flank and said tongue tip.

* * * * *

UNITED STATES PATENT AND TRADEMARK OFFICE

CERTIFICATE OF CORRECTION

PATENT NO. : 4,739,805

DATED : April 26, 1988

INVENTOR(S) : LOTHAR KOHLER

It is certified that error appears in the above-identified patent and that said Letters Patent is hereby corrected as shown below:

Column 1, line 26 "both the" should be -both of the-
Column 2, line 1 "grooves" should be -groove- Signed and Sealed this Twenty-seventh Day of September, 1988

*Attest:*

DONALD J. QUIGG

*Attesting Officer*

*Commissioner of Patents and Trademarks*